United States Patent [19]

Sheer et al.

[11] 4,080,550

[45] Mar. 21, 1978

[54] METHOD AND APPARATUS FOR PROJECTING SOLIDS-CONTAINING GASEOUS MEDIA INTO AN ARC DISCHARGE

[75] Inventors: Charles Sheer, Teaneck, N.J.; Samuel Korman, Hewlett, N.Y.

[73] Assignee: Sheer-Korman Associates, Inc., New York, N.Y.

[21] Appl. No.: 755,652

[22] Filed: Dec. 30, 1976

[51] Int. Cl.[2] ..... H01J 7/26; H05B 31/24; H05B 31/26

[52] U.S. Cl. ..... 315/111.2; 313/11; 313/231.4; 219/121 P

[58] Field of Search ..... 315/111.2; 313/231.4, 313/231.3, 231; 219/121 P, 76

[56] References Cited

U.S. PATENT DOCUMENTS

| | | | |
|---|---|---|---|
| 3,209,193 | 9/1965 | Sheer et al. | 313/231.4 |
| 3,214,623 | 10/1965 | Sheer | 313/231.4 |
| 3,644,781 | 2/1972 | Sheer et al. | 315/111.2 |
| 3,644,782 | 2/1972 | Sheer et al. | 315/111.2 |
| 3,900,762 | 8/1975 | Sheer et al. | 315/111 |

*Primary Examiner*—Eli Lieberman

*Assistant Examiner*—Charles F. Roberts

*Attorney, Agent, or Firm*—Hammond & Littell

[57] ABSTRACT

An improved apparatus for projecting a solids-containing gaseous media into an arc discharge utilizing a cone shaped cathode, with a passage along the conical surface thereof for insertion of gaseous media into the arc discharge, employing a plurality of individual linear feed channels having a constant flow cross-sectional area in said passage, said individual feed channels being supplied from a common source of a solids entrained gaseous media through flow splitters splitting said gaseous media into equal amounts, said flow splitters having two or more converging channels on the outlet side forming an angle of 15° or less, opening into a channel of the same or greater cross-sectional area as the sum of the areas of the two or more converging channels, where the outlet area of said plurality of individual linear feed channels is extensively cooled to maintain the surface temperature of the outlet area below the temperature at which the solids contained in said gaseous media agglomerate; as well as the method for energizing a solids-containing gaseous media by means of an arc discharge employing said improved apparatus.

7 Claims, 8 Drawing Figures

FIG. 2
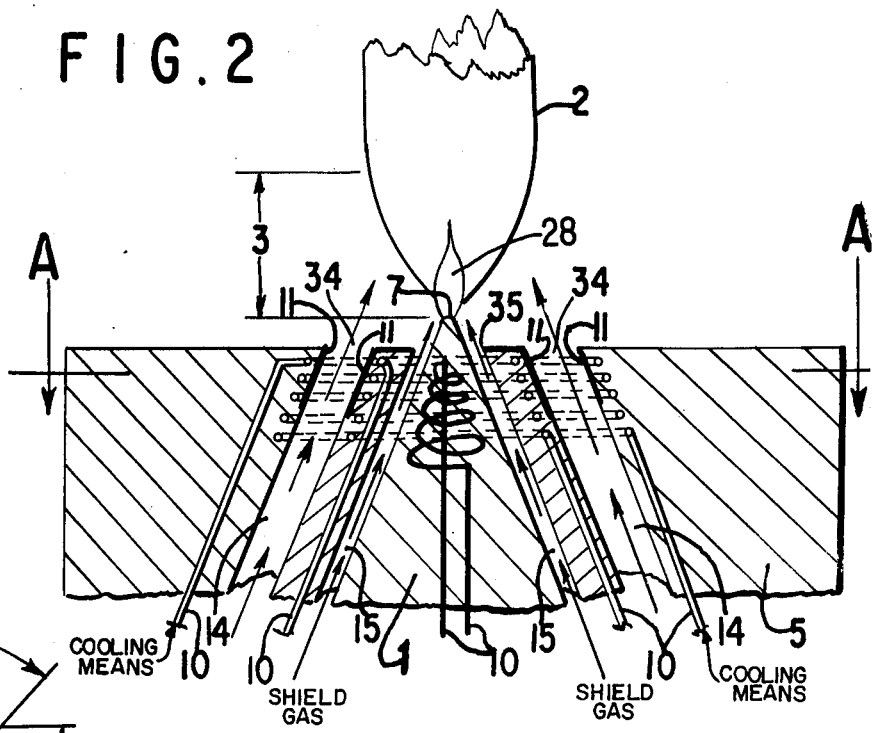
FIG. 1
PRIOR ART
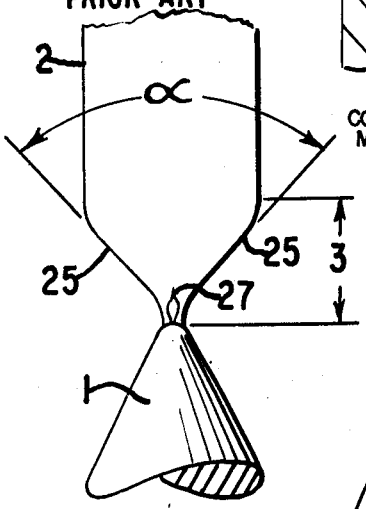
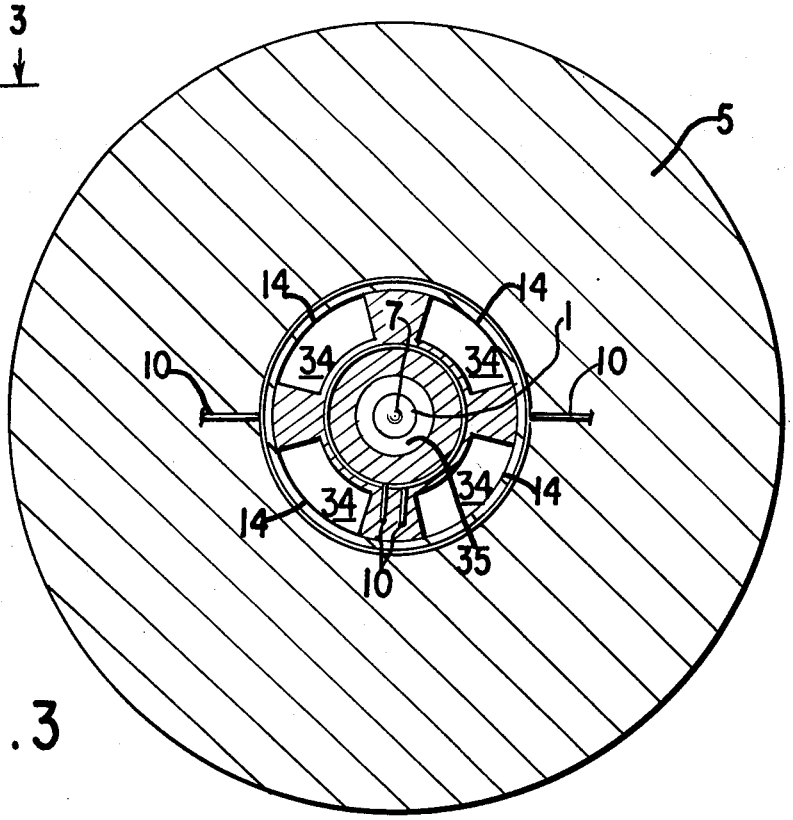
FIG. 3

FIG. 4
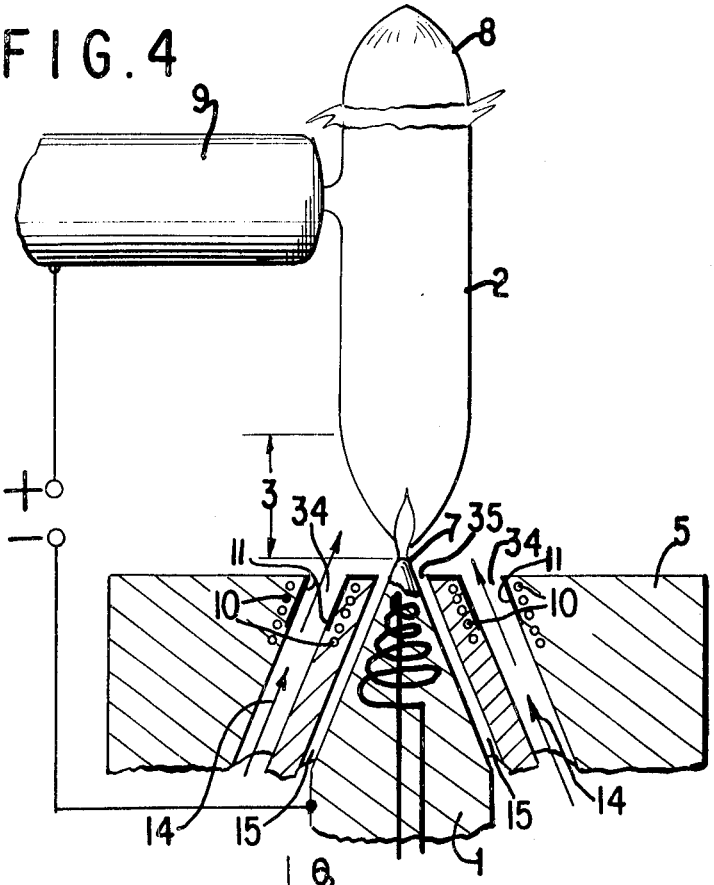
FIG. 5
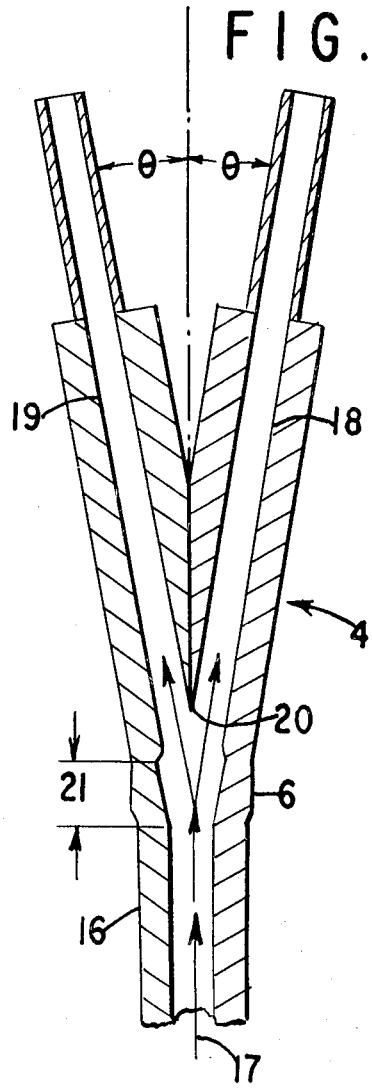
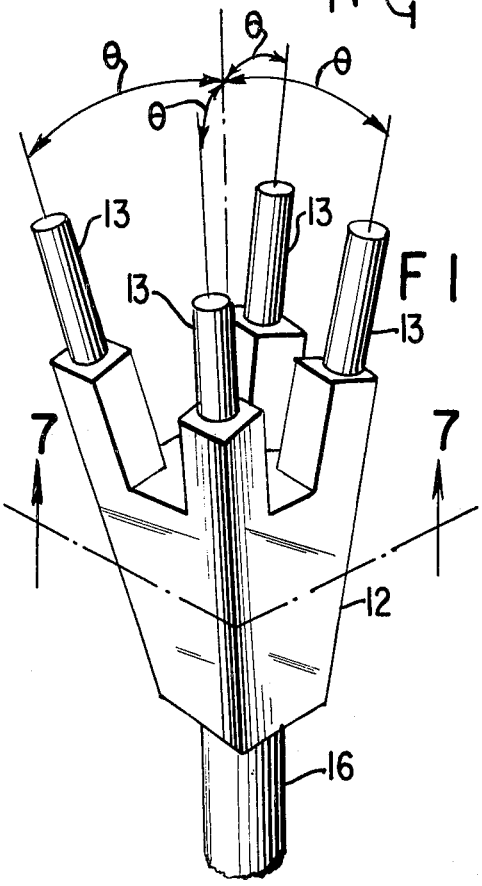
FIG. 6
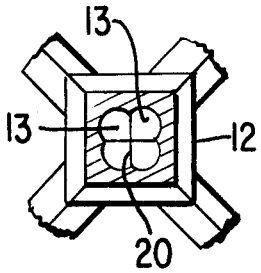
FIG. 7

METHOD AND APPARATUS FOR PROJECTING SOLIDS-CONTAINING GASEOUS MEDIA INTO AN ARC DISCHARGE

THE RELATED ART

As is well known, a high intensity arc is an electric discharge between a cathode and an anode of such intensity that the material of the anode is vaporized and converted into a plasma jet, shooting off into space, away from the anode.

Methods and devices for transferring energy to fluid materials also by exposing said fluid material to the energy of a high intensity arc have been previously reported. For example, in U.S. Pat. No. 3,209,193, a novel method of exposing the fluid to the energy of the arc is disclosed, which consists of passing the fluid continuously through a porous anode so that it enters the discharge via the active anode surface, i.e., where said surface is acting as the arc terminus. That patent further discloses that unique and valuable results can be obtained if certain criteria are satisfied in operating such a device.

U.S. Pat. No. 3,214,623 describes an improvement to the above patent where the arc discharge has an essentially conical geometry. The cathode, porous anode and insulating supports are arranged geometrically to each other, so that the conduction column assumes the shape of an axially symmetrical conical shell.

The technique of fluid injection through a porous anode has been termed the "fluid transpiration arc" (FTA), and is an example of the use of a high intensity arc to transfer energy to materials.

Attempts have also been made to inject a working fluid into the interior of an arc column at other points than the anode. Many difficulties have been found in these attempts. For example, in the constricted art column of a conventional wall-stabilized arc with a segmented, watercooled constrictor channel long enough to assure the establishment of a fully developed column, the injected gas is forced to flow axially, concentric and parallel to the conduction column. Since the column in this device is subject to an appreciable thermal constriction, it would seem that the convected gas would be forced through the column boundary into the primary energy dissipating zone. It was found, however, that, even in the fully developed region, beyond which the radial distributions of the flow parameters remain constant, by far the major part of the flow traverses the thin, cool, nonconducting gas film adjacent to the channel wall. In fact only about 10 percent of the mass flow enters the hot core. The much higher density and lower viscosity of the cool gas in the wall layer, plus the fact that even a very thin film can have appreciable cross-sectional area near the wall, compensate for the lower velocity of the cool gas layer, and account for nearly all of the convected mass flow. It should be noted that the radial temperature across the fully developed portion of the column remains above 10,000° K. over 80 percent of the channel diameter, so that the plasma fills the channel quite well. The conclusion is that most of the working fluid does not penetrate the column and is therefore not directly exposed to the zone of maximum energy dissipation.

The same effect is noted with other flow configurations. For example, if a stream of gas is projected at right angles against the column of a free- burning arc, the arc will be blown out at quite low-flow rates. However, the column can be stabilized by a magnetic field of suitable strength oriented normal to both column and gas flow so as to balance exactly the force of convection. Even when the balance is established at very high-flow rates, the gas does not enter the column, but is deflected around it, the column behaving much like a solid cylinder. An examination of existing arc jet devices reveals that in nearly every case most of the working fluid does not penetrate into the column and is not subjected to the zone of direct energy transfer.

A most important development in the process of injecting a working fluid into the interior of an arc column was described in U.S. Pat. Nos. 3,644,781 and 3,644,782. These patents describe how the contraction zone, wherein the current-carrying area of the arc column decreases and which is formed adjacent to the cathode tip, can serve as an "injection window" into the arc column. Thus, when a gas is caused to impinge directly on the contraction zone boundary it will penetrate into the arc column at flow rates far in excess of what can be forced across the cylindrical column boundary of the arc. Gas flow rates of the magnitude much greater than that aspirated naturally can be injected into the column without disturbing the stability of the arc when the gas is forced to follow the conical configuration of the cathode tip. For this purpose, the gas to be injected must be projected in a high-velocity layer along the conical cathode surface.

By proper adjustment of the gas velocity and cone angle of the cathode, the gas can be made to cross the column boundary in essentially the same general direction as would the aspirated ambient gas stream in the absence of forced convection. The optimum cone angle for this purpose appears to be between 30° and 60°.

A second critical parameter described in these patents is the injection velocity. This can be varied without altering the total mass flow (convection) rate by varying the area of the annular orifice and changing the inlet gas pressure as required to maintain a fixed flow rate. It was observed, for example, that as the injection velocity (mass flow density) was varied, the column temperature passes through a peak, with the maximum temperature rising to two or three times that obtained when the velocity was several times higher or lower than its optimum value.

A third critical parameter described in these patents is the total mass flow of the injected fluid medium. As the total mass flow of the injected fluid medium is varied at substantially constant current levels and mass flow density, an alteration of the shape of the contraction zone occurs. When the total mass flow or convection rate of the injected fluid medium is increased from zero, little or no change in the shape of the contraction zone is observed and substantially all of the injected fluid enters the arc column through the injection window. However, as the total mass flow of the injected fluid medium is increased further, at a point depending on the medium injected, the contraction zone begins to elongate, thus decreasing the space rate of contraction of the arc column diameter. This space rate of contraction may be characterized by the window angle $\alpha$ (see FIG. 1). When the angle $\alpha$ is sufficiently reduced, that is, about 40° or less, the major portion of the flow of the fluid medium does not enter the arc column.

This technique of injecting the working fluid into the contraction region of the arc column has been termed the "forced convection cathode" arc (FCC), and is principally described in U.S. Pat. No. 3,644,782. U.S.

Pat. No. 3,644,781 describes the operation of the FCC with a heterogeneous material where the introduction into the fluid medium injected of a finely divided non-gaseous material causes an enlargement of the window angle $\alpha$, thus enabling the insertion of an increased amount of the non-gaseous material.

An improvement in the operation of the FCC is described in U.S. Pat. No. 3,900,762 which involves interposing a stream of shielding gas between the cathode producing the arc and the reactive material being inserted into the arc.

It was found, however, that the operation of the FCC with insertion of a reactive material, presented difficulties as to uniform feed when large amounts of a reactive solid are fed into the fluid medium being injected along the conical cathode into the contraction zone.

OBJECTS OF THE INVENTION

An object of the present invention is the development of a method and apparatus to give a uniform injection of a reactive solid entrained in a fluid medium into the contraction zone.

Another object of the present invention is the development of an apparatus for projecting a solids-containing fluid medium into an arc column comprising:

a. an anode and a cathode having a conical tip;

b. means for providing a free-burning arc discharge between said anode and said cathode whereby said arc discharge forms a plasma bubble and a contraction in the cathode-carrying area in the transition region adjacent to the cathode;

c. directing means for projecting a solids-containing fluid medium substantially parallel to the surface of the conical tip of said cathode into said contraction of the current-carrying area along a path which intersects beyond said plasma bubble, comprising a plurality of individual linear feed channels having a constant flow cross-sectional area, said individual feed channels being supplied from a common source of a solids-containing fluid medium through flow splitters having two or more converging channels on the outlet side of equal cross-sectional area forming an angle of 15° or less opening into a channel of the same or greater cross-sectional area as the area of the two or more converging channels whereby the flow of said solids-containing fluid medium is divided into streams of equal flow rate and grain loading;

d. extensive cooling means in the outlet area of said plurality of individual linear feed channels to maintain the surface temperature of said outlet area below the temperature at which the solids in said solids-containing fluid medium agglomerate.

A further object of the present invention is the development of an improvement in the process of energizing a reactive material comprising a solids-containing fluid medium by means of a free-burning arc discharge between an anode and a cathode having a conical tip, wherein said arc discharge forms a contraction of the current-carrying area in the transition region adjacent to the cathode and wherein said reactive material is forcefully projected along the surface of said conical tip of said cathode into and through said contraction of the current-carrying area in the transition region adjacent to the cathode, the said improvement comprising projecting said reactive material through a plurality of individual linear feed channels having a constant flow cross-sectional area, said individual feed channels being supplied from a common source of a solids-containing fluid medium through flow splitters having two or more converging channels on the outlet side of equal cross-sectional area forming an angle of 15° or less opening into a channel of the same or greater cross-sectional area as the combined area of the two or more converging channels whereby the flow of said solids-containing fluid medium is divided into streams of equal flow rate and grain loading; and extensively cooling the outlet area of said plurality of individual linear feed channels whereby the surface temperature of said outlet area is maintained below the temperature at which the solids in said solids-containing fluid medium agglomerate.

These and other objects of the invention will become more apparent as the description thereof proceeds.

THE DRAWINGS

FIG. 1 is a schematic diagram of the prior art showing the plasma bubble and illustrating the arc column contraction, the degree of contraction being specified by the angle $\alpha$ in the vicinity of a cathode having a conical tip.

FIG. 2 is an enlarged cross-section of the embodiment of the present invention showing the method of operation of the invention with a cathode provided with a second concentric conical shroud and showing the area of extensive cooling.

FIG. 3 is a view along line A—A of FIG. 2.

FIG. 4 is a cross-section of the apparatus of the invention including a representative anode.

FIG. 5 is a cross-section view of a two conduit splitter.

FIG. 6 is a perspective view of a four conduit splitter supplying the individual feed channels shown in FIG. 3.

FIG. 7 is a cross-section view along line 7—7 of FIG. 6.

DESCRIPTION OF THE INVENTION

Figure 8:
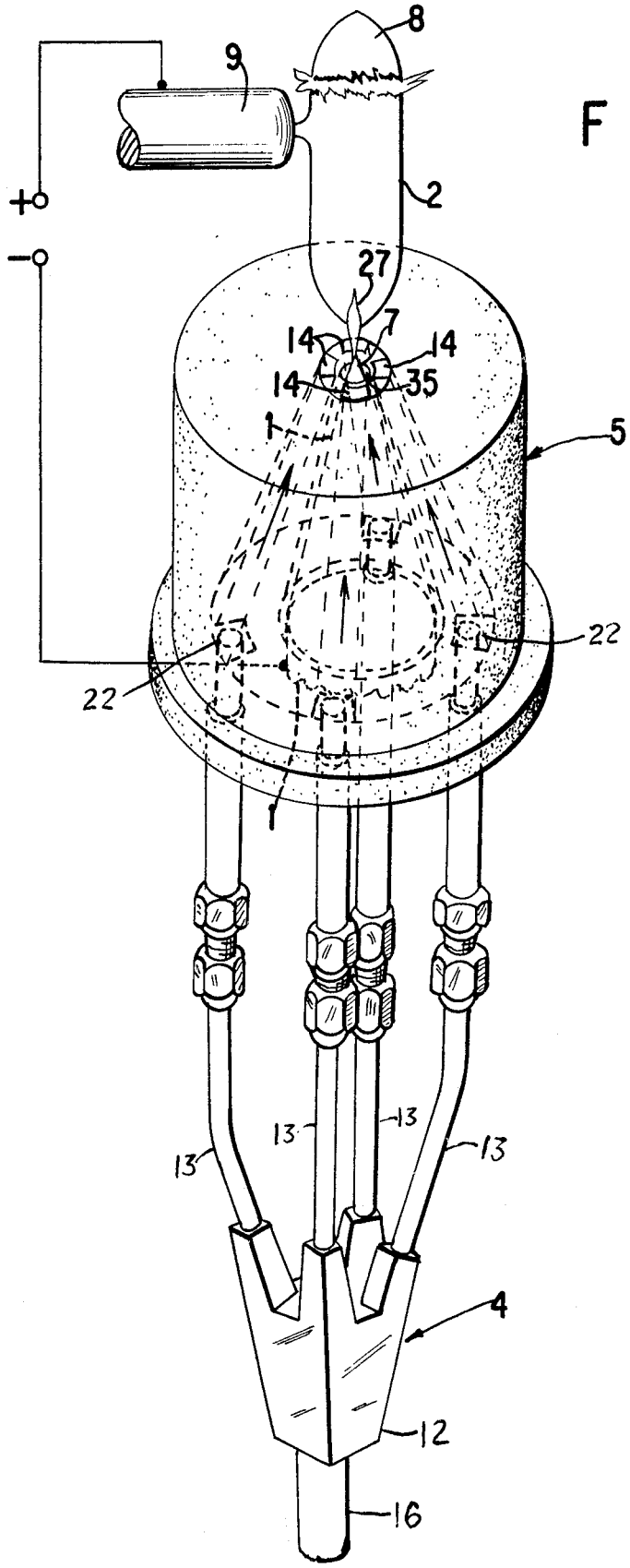
FIG. 8 is a perspective view of the device of the invention.

Referring to FIG. 1, when an arc is struck between an anode (not shown) and a cathode having a conical tip, there occurs a contraction of the current carrying area in the transition region between the cathode 1 and the conduction column proper 2. This contraction is indicated as contraction zone 3. The degree of contraction of the current carrying area in the transition region between the cathode 1 and the column proper 2 may be specified by the angle $\alpha$ which is determined by extending lines tangent to the column boundary at the points of inflection 25 of the contraction. This contraction causes the natural cathode jet effect as will be explained subsequently.

The current density, and therefore the self-magnetic field due to the arc current, increases toward the cathode as a result of the contraction of the current carrying area. This non-uniform magnetic field exerts a body force on the electrically conducting plasma, propelling it in the direction of maximum decrease in magnetic field, i.e., along the arc axis away from the cathode tip. The streaming of plasma away from the cathode tip decreases the local pressure in the immediate vicinity of the cathode tip. This pressure decrease establishes a pressure gradient across the contraction zone boundary into the column and causes the arc to aspirate gas from the surrounding atmosphere. This mechanism establishes the well-known natural cathode jet which has been observed to flow along the axis of the column away from the cathode tip in all arcs characterized by a contraction zone adjacent to the cathode.

In view of the fact that there exists an inwardly directed pressure gradient in the vicinity of the cathode tip, contraction zone 3 can serve as an "injection window" through which materials may be injected directly into arc column 2. Indeed, it has been found that feed flow rates of a magnitude much greater than that aspirated naturally can be injected into the column through the injection window without disturbing the stability of the arc. The effect of the forced convection is to increase both the current density and the voltage gradient in and near the contraction zone, thereby increasing the volume rate of energy dissipation within this portion of the column, making available the additional energy needed to heat the increased quantity of material which penetrates into the column. In short, the injection of a copious stream of gas into the column through the injection window is not only possible, but actually increases the heat transfer effectiveness of this part of the arc. However, the increase in gas convection rate does affect the angle $\alpha$ and if the angle $\alpha$ is reduced below about 40°, the amount of material that can be injected into the arc column 2 through the window is limited substantially.

When the gas convection rates are increased too much, the size of the "window", so to speak, is reduced, thereby placing practical limits on efficient use of the arc. To achieve the effect described, the gas or reactive materials injected into the arc must be projected at a high velocity at least parallel to the conical cathode surface and preferably normal to the contraction zone boundary.

By proper adjustment of the gas velocity along the angle of the cathode, the gas can be made to cross the column boundary in essentially the same general direction as would be the gas aspirated from the surrounding atmosphere in the absence of forced convection. The optimum cathode cone angle for this purpose appears to be between 30° and 60°. The term "cone angle" refers to the vertex angle of the converging segment of the cathode cone. However, cone angles from 20° to 135° may be employed in the instant invention, depending partly on the material of the cathode and the type of fluid material injected into the arc.

A distinctive feature of the contraction zone is a small brilliant tear drop shaped zone having a bluish tinge and located at the end of a conical cathode tip. This zone is hereinafter referred to as the "plasma bubble". It is shown, in FIG. 1, as reference 27. The temperature within the bubble is exceedingly high, generally in excess of 20,000° C, and it serves as a very effective generator of charge carriers (ions and electrons). During forced convection the charge carriers are being rapidly depleted and efficient generation of new charge carriers is necessary to prevent arc instability.

When the FCC is operating in steady state by projecting a gaseous medium into the arc column via the contraction zone "window", with the nozzle orifice area always adjusted for optimum mass flow density (maximum column temperature), the degree of penetration of the gaseous medium is determined by the window angle, $\alpha$. (See FIG. (1)) As mentioned earlier, the window angle $\alpha$ depends on the convection rate of gas, changing very little at low flow rates, but decreasing at high flow rates. When $\alpha$ drops to the region of 40°, the penetration becomes limited to a minor fraction of the total flow. If, however, under such conditions, i.e. if the total flow is high enough to cause a significant decrease in $\alpha$ and if all other conditions (arc current, mass flow density, and gas convection rate) are held constant, then the entrainment in the gas stream of a finely-divided non-gaseous material, e.g. a powdered solid, will cause the angle $\alpha$ to increase, thus neutralizing the effect of the high gas convection rate on the window angle and improving the penetration beyond that for the gas alone.

This effect is due to an enlargement of the arc column which is observed to occur whenever the injected gas stream contains significant amounts of solid material entrained in the gas as small particles. It is believed to be caused by the vapor pressure generated by vaporizing particles in the column core which would be expected to cause a radial expansion of the column. This view is consistent with the observations that except very near the cathode, the column enlarges radially with the introduction of a heterogeneous feed along its entire length, and that the enlargement increases with distance away from the cathode, i.e., the column shape changes from that of a cylinder to a more or less diverging cone. Of particular interest is the fact that the area of the plasma bubble does not change with heterogeneous feed. Hence the space rate of column contraction adjacent to the cathode increases and, therefore, the window angle, increases with heterogeneous feed.

This enlargement of the window angle occurs, as indicated, after the introduction into the gaseous injected feed of finely divided solids which vaporize in the column core and are, therefore, capable of enlarging the window angle. Since the temperature in the column core is in excess of 10,000° K., most particulated solids will undergo some degree of vaporization. The enlargement of the angle $\alpha$ will depend on the material introduced and, therefore, varies somewhat.

When attempts were made to feed solid powders entrained in a gas flow through an annular convergent nozzle, it was found to be extremely difficult to maintain uniform grain loading azimuthally about the axis. After a relatively short time the powder would begin to agglomerate at a particular angular position. This caused increased powder drop-out, building up a resistance to flow which became progressively worse until complete blockage occurred at a particular position within the nozzle. This caused asymmetric gas flow, distorting the column and preventing effective penetration of the feed into the arc.

This difficulty is overcome according to the present invention by the following three steps:

1. Utilizing a plurality of individual linear channels arranged in a convergent array symmetrically with respect to the cathode axis. The important factor involved in this improved feed concept is that each of the individual feed channels maintains a constant flow cross-sectional area over its length in contrast to a convergent annular nozzle in which the cross-sectional area decreases continuously with decreasing distance from the orifice. By using the multiplicity of linear channels, it is possible to feed a heterogeneous gas-solid mixture successfully for indefinite periods of time with heavier grain loading than otherwise possible.

2. Supplying the individual feed channels from a common source of a solids-containing fluid medium by dividing the single feed conduit in which the powdered material is entrained, into a plurality of separate conduits, of essential equal grain loading, for feeding each of the above-mentioned linear channels. We have found that the conventional method of dividing the flow from a single conduit into two individual conduits, for example by means of a "Tee" connection, is not generally applicable to the case of heterogeneous flows. Powder drop-out or unequal grain loading, often culminating in blockage of one of the channels, is apt to occur. After considerable experimentation, we have developed a configuration which permitted division of flow with equal grain loading and without dropout or blockage, even for heavily loaded heterogeneous flows. This equal division of flow is accomplished by flow splitters having two or more converging outlet channels of equal cross-sectional area forming an angle of 15° or less with the extension of the axis of the inlet channel, opening into an inlet channel of the same or greater the cross-sectional area as the sum of the areas of the two or more converging outlet channels.

This splitting technique may be used to divide the flow in a single conduit into three, four or more individual conduits, of essentially equal gas flow rate and grain loading, provided that the outlet conduits have constant cross-sectional area and are symmetrically arranged about the extension of the axis of the inlet conduit, that the converging outlet conduits make an angle not greater than 15° with said inlet conduit axis extension, and that the cross-sectional area of the inlet conduit be equal to or greater than the sum of the individual cross-sectional areas of all the outlet conduits.

3. Extensively cooling the outlet area of the individual feed channels to maintain the surface temperature of the outlet area below the temperature at which the solids in the solids-containing fluid medium agglomerate.

More particularly, therefore, the present invention involves an apparatus for projecting a solids-containing fluid medium into an arc column comprising:

a. an anode and a cathode having a conical tip;
b. means for providing a free-burning arc discharge between said anode and said cathode whereby said arc discharge forms a plasma bubble and a contraction in the current-carrying area in the transition region in the vicinity of the cathode;
c. directing means for projecting a solids-containing fluid medium substantially parallel to the surface of the conical tip of said cathode into said contraction of the current-carrying area along a path which intersects beyond said plasma bubble, comprising a plurality of individual linear feed channels having a constant flow cross-sectional area, said individual feed channels being supplied from a common source of a solids-containing fluid medium through flow splitters having two or more converging channels on the outlet side of equal cross-sectional area forming an angle 15° or less with the extension of the axis of the inlet channels, opening into an inlet channel of the same or greater cross-sectional area as the sum of the areas of the two or more converging channels whereby the flow of said solids-containing fluid medium is divided into streams of equal flow rate with equal grain loading;
d. extensive cooling means in the outlet area of said plurality of individual linear feed channels to maintain the surface temperature of said outlet area below the temperature at which the solids in said solids-containing fluid medium agglomerate.

In addition, the present invention involves an improvement in the process of energizing a reactive material comprising a solids-containing fluid medium by means of a free-burning arc discharge between an anode and a cathode having a conical tip, wherein said arc discharge forms a contraction of the current-carrying area in the transition region in the vicinity of the cathode and wherein said reactive material is forcefully projected along the surface of said conical tip of said cathode into and through said contraction of the current-carrying area in the transition region in the vicinity of the cathode, the improvement comprising projecting said reactive material through a plurality of individual linear feed channels having a constant flow cross-sectional area, said individual feed channels being supplied from a common source of a solids-containing fluid medium through flow splitters having two or more converging channels on the outlet side of equal cross-sectional area forming an angle of 15° or less with the extension of the axis of the inlet channel opening into the inlet channel of equal or greater cross-sectional area as the sum of the areas of the two or more converging channels whereby the flow of said solids-containing fluid medium is divided into streams of equal flow rate and with equal grain loading, and extensively cooling the outlet area of said plurality of individual linear feed channels whereby the surface temperature of said outlet area is maintained below the temperature at which the solids in said solids-containing fluid medium agglomerate.

EXAMPLE

The device of the present invention is most clearly depicted in FIG. 2, a longitudinally sectional view, and FIG. 3, a cross-sectional view along A—A of FIG. 2, as well as in FIGS. 5, 6 and 8.

The cathode 1 is water cooled and extends in the form of a conical tip with a 45° cone angle. Surrounding the cathode is a conical shroud 5 defining an annular passage 15. Shroud 5 also has a cone angle of 45° so that it mates with the conical tip of the cathode. Shroud 5 is pierced with a plurality of linear feed channels 14 which form paths substantially parallel to annular passage 15. These linear feed channels 14 are of a uniform cross-sectional area throughout the entire length of shroud 5. Both annular passage 15 and linear feed channels 14 are shown to be parallel to the surface of the conical cathode. However, the linear feed channels 14 can vary slightly from being substantially parallel to the surface of the conical cathode 1.

Shroud 5 terminates a few millimeters behind the cathode tip 7, thus forming annular orifice 35. The linear feed channels through shroud 5 have orifices at 34. In FIGS. 3, 4 linear feed channels 14 are shown. However, any other practical number of linear feed channels 14 may be employed. Preferably they are equally spaced apart from each other about the cathode tip 7.

Preferably the device of the invention contains the annular passage 15, however, the same can be omitted provided the feed material does not attack the hot cathode tip. Annular passage 15 is effective in interposing a stream of shielding gas between the solids-containing fluid medium in linear feed channels 14 and the cathode 1.

This stream of shielding gas is useful in order to maintain the integrity of the conical tip. By this method, the conical cathode tip is protected or shielded against physical abrasion and/or chemical attack by reactive materials which are projected along the linear feed channels 14 or which back diffuse from the column.

By shielding gas is meant any gas which is not active, i.e., chemically reactive toward the cathode material, at prevailing cathode temperatures during arc operation.

Typical shielding gases, especially with tungsten or copper electrodes, are the following: helium, argon, neon, nitrogen, hydrogen and the like.

Reactive materials are those which will cause physical and/or chemical changes at the temperatures of the cathode surface during operation of the arc and which are chemically active toward the cathode material. These materials may include the condensed phase particulates entrained in the gas.

In addition to protecting the conical cathode surface against physical abrasion and chemical attack, interposing a stream of shielding gas between the cathode and the reactive material fed into the injection window in accordance with the present invention surprisingly widens the conduction column beyond the contraction zone and contributes vastly to arc stability. The basis for this surprising phenomena is believed to be associated with the "plasma bubble".

In any event, the size and shape of the plasma bubble appears to be influenced by the material projected into the column via the injection window. Injection of a non-reactive gas into the column through the portion of the injection window close to the cathode tip 7 enlarges the plasma bubble and increases its temperature. (In FIG. 2, an enlarged plasma bubble is shown at 28). However, introducing reactive material such as polyatomic gases or solids into the plasma bubble, reduces the bubble temperature and therefore also the ion generation rate. This decrease of charge carriers in the conduction column, occurring as a result of forced convection, renders the arc unstable and ultimately extinguishes it. In contrast, when a non-reactive shielding gas is interposed between the cathode and the reactive material fed into the arc column via the injection window, the non-reactive gas enters the plasma bubble without depleting charge carrier generation, while the reactive material is injected essentially above the plasma bubble so that little or no reactive material enters it and is fed to the column without detrimentally affecting arc stability.

Accordingly, the linear feed channels 14 are designed in order that the reactive material (solids-containing fluid medium) enters the column through the injection window along a path which intersects just beyond the bubble. The concomitant result is a widening of the column just above the plasma bubble, thus creating additional window space.

The dimensions of the annular orifice 35 and the feed channel orifices 34 are such that both streams of fluids can enter the column via the contraction zone or window. The inlet orifice area together with the inlet gas pressures will affect the injection velocity (mass flow density). By adjusting the gas pressure, the injection velocity may be varied without altering the total mass flow (convection). Preferably the shielding gas and reactive fluid orifices are sized so that little, if any, reactive material enters the plasma bubble and instead the reactive material enters the injection window along a path which intersects just beyond the plasma bubble.

Inserted in the shroud 5 adjacent to the outlet orifices 34 of the linear feed channels 14 are cooling passages 10. These passages 10 surround the outlet orifices 34 and are designed to maintain the temperature of the outlet orifices 34 below the agglomeration temperature of the solids in the solid-containing fluid medium being injected through the linear feed channels 14. These cooling passages 10 provide for extensive cooling of the orifice outlets 34.

It was found that this extensive cooling is applicable to many types of entrained solids and is particularly important in the case of powdered coal. Thus, when the device was placed in operation without cooling, it was noted that, after a few minutes of operation, the powdered coal began to adhere to the surfaces of the linear channels 14 near their orifices 34. This caused a build-up of partially agglomerated coal particles which ultimately blocked the channels and prevented further operation. The regions thus affected are designated by the heavy lines 11 in FIG. 2. These surfaces are exposed to radiant heating by the arc column, which is in close proximity. For this reason both the inner and outer shrouds of the FCC are water-cooled. The normal criterion for applying water-cooling to the FCC structures and to other parts of arc devices, is to preserve the structural integrity of the part. This requires water-cooling sufficient to maintain the exposed surfaces at a temperature below the melting point of the material of construction. Since these devices are generally made of copper, this means that water-cooling sufficient to keep the surfaces below about 700° C to 800° C is required. The amount of water-cooling commonly used keeps the surface temperature to about 400° C to 500° C in order to avoid too much thermal expansion, surface corrosion, etc. We have found that at such temperature agglomeration of coal particles on the surfaces occurs, causing the build-up referred to above. We have discovered, however, that by vigorous water-cooling using high pressure, high velocity circuits, such that the surfaces are maintained at a sufficiently lower temperature, e.g. about 200° C, that agglomeration of coal does not occur on the exposed surfaces 11 and that operation with entrained coal can proceed indefinitely.

The linear feed channels 14 are maintained at a constant cross-sectional area throughout their length through shroud 5. However, it is preferable to have their outlet orifices 34 in the form of an arcuate slit having sides of a curvature parallel to the curvature of the conical tip of the cathode 1, whereas it is preferable to have the inlet 22, as shown in FIG. 8 in the form of a circle. This can be readily designed. The cross-sectional area from the arcuate slit orifice to the circular inlet is maintained constant. Likewise, each of the linear feed channels 14 has the same cross-sectional area.

The feeding of these individual linear feed channels 14 must be at an equal rate with a uniform solids-containing fluid medium. This requires the division of the flow of the solids-containing fluid medium in the two conduit flow splitter 4 as shown in FIG. 5. In this two conduit flow splitter 4, a conduit 16 having a cross-sectional area A, is provided through which gas with entrained powder is flowing in the direction of the arrow 17. This conduit 16 divides into two conduits 18 and 19, each having a cross-sectional area of not more than ½A, at the junction 6. The angle $\theta$ which conduits 18 and 19 make with the axis of conduit 16 should be kept to as low a value as possible and the angle formed by conduits 18 and 19, with the extended axis of conduit 16, should be 15° or less.

We have found that an angle $\theta$ of 10° will permit equal division of the flow with negligible drop-out or other adverse effects. As $\theta$ is made larger, the performance becomes less and less satisfactory in terms of the total grain loading permissible without dropout or unequal division. We have also found it useful to ensure that the apex 20 at the juncture of conduits 18 and 19 be made sharp and that for a short distance in the vicinity of apex 20 the inside diameter of conduit 16 be enlarged somewhat, as shown at 21.

This configuration can be adapted to splitting into any number of equal flows. For example, the conduit 16 can be joined to 3 conduits, each of cross-sectional area not exceeding $\frac{1}{3}$A, each of whose axes makes an angle of 10° with the extended axis of conduit 16, and which are spaced 120° about the axis of conduit 16. Similarly, division into four conduits, of area equal to or less than $\frac{1}{4}$A, can be made by spacing them at 90° about the axis of conduit 16, each inclined at 10°, etc.

A four channel flow splitter 12 is disclosed in FIG. 6 wherein the angle $\theta$ between the four conduits 13 and the extended axis of conduit 16 is 10°.

FIGS. 4 and 8 show an overall configuration of the device of the invention showing the anode 9 and the tail flame 8 of arc column 2. Preferably 3 or more anodes are employed in a plane at equidistances from each other.

In operation the orifice areas ranged from about 0.015 $in^2$ for orifice 35 to about 0.12 $in^2$ for each of orifices 34.

The arc is ignited as follows:

1. The electrodes are brought in close proximity to each other, e.g., about 10mm. A moderate flow of shielding gas is started and introduced via annular passage 15. The starting flow of gas is normally about 2 to about 8 grams per minute. The arc is then ignited using a momentary high frequency spark to form a conductive path between the closely spaced electrodes. With the main power supply turned on, a rapid spark to arc transition occurs.

2. Once the arc is ignited, the arc gap is increased to its desired value by withdrawing the cathode.

To start up and maintain stable operation of the arc, the following parameters have been employed:

| | |
|---|---|
| Arc current | 50 - 750 amps |
| Arc voltage | 50 - 235 volts |
| Arc gap | 0.3 - 1.0 centimeters (startup)<br>8 - 20 centimeters (operation) |
| Mass flow rate of inert gas | 3 - 10 grams/minute (inner shroud) |
| Mass flow rate of reactive gas | 0 - 50 grams/minute (each linear feed channel) |

3. When optimum conditions are obtained, that is, when the maximum column temperature is reached with total mass flow of the fluid medium well below the value which would reduce the angle $\alpha$ to less than about 40°, the condensed phase is entrained in the fluid medium and introduced into the arc via linear feed channels 14. The amount of material entrained is kept initially low and slowly increased until the fraction of the mass flow of dense material is comparable to that of the entraining material. The optimum mass flow rate of shielding gas introduced via passage 15 is in the range of 4 to 15 gm/min., and the mass flow of carrier gas (fluid entraining medium) introduced via channels 14 is in the range of 50 to 160 gm/min.

At the point where the mass flow of entrained material is comparable to that of the carrier fluid medium, the window angle is enlarged and the mass flow may be increased further without serious loss of penetration into the column.

The solids-containing fluid medium is almost entirely projected into the column without loss of solids due to swirling or agglomeration.

For the optimum utilization of the invention, as shown in FIG. 8, the four channel flow splitter 12 is employed with the four individual feed channels 14 and the intensive cooling passages 10. However, the shroud 5 with the individual feed channels 14 can be utilized with a feed other than that from the four channel flow splitter 12. Individual carrier gas supplies with equal grain loadings of particulate materials may be provided to feed the inlets of the individual feed channels.

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. An apparatus for projecting a solids-containing fluid medium into an arc column comprising:

a. an anode and a cathode having a conical tip;

b. means for providing a free-burning arc discharge between said anode and said cathode whereby said arc discharge forms a plasma bubble and a contraction in the current-carrying area in the transition region in the vicinity of the cathode;

c. directing means for projecting a solids-containing fluid medium substantially parallel to the surface of the conical tip of said cathode into said contraction of the current-carrying area along a path which intersects beyond said plasma bubble, comprising a plurality of individual linear feed channels having a constant flow cross-sectional area, said individual feed channels being supplied from a common source of a solids-containing fluid medium through flow splitters having two or more converging channels on the outlet side of equal cross-sectional area forming an angle of 15° or less with the extension of the axis of the inlet channel opening into an inlet channel of the same or greater cross-sectional area as the sum of the areas of the two or more converging channels whereby the flow of said solids-containing fluid medium is divided into streams of essentially equal flow rate and grain loading;

d. Extensive cooling means in the outlet area of said plurality of individual linear feed channels to maintain the surface temperature of said outlet area below the temperature at which the solids in said solids-containing fluid medium agglomerate.

2. The apparatus of claim 1 wherein the angle of said converging channels with the extension of the inlet axis is 10°.

3. The apparatus of claim 1 wherein said flow splitters have four converging channels.

4. The apparatus of claim 1 wherein said outlet area of said plurality of individual linear flow channels is maintained at a temperature of about 200° C.

5. In the process of energizing a reactive material comprising a solids-containing fluid medium by means of a free-burning arc discharge between an anode and a cathode having a conical tip, wherein said arc discharge forms a contraction of the current-carrying area in the transition region in the vicinity of the cathode and wherein said reactive material is forcefully projected parallel to the surface of said conical tip of said cathode into and through said contraction of the current-carrying area in the transition region in the vicinity of the cathode, the improvement comprising projecting said reactive material through a plurality of individual linear feed channels having a constant flow cross-sectional area, said individual feed channels being supplied from a common source of a solids-containing fluid medium through flow splitters having two or more converging channels on the outlet side of equal cross-sectional area forming an angle of 15° or less with the extension of the axis of the inlet channel opening into the inlet channel of equal or greater cross-sectional area as the sum of the areas of the two or more converging channels whereby the flow of said solids-containing fluid medium is divided into streams of essentially equal flow rate and grain loading and extensively cooling the outlet area of said plurality of individual linear feed channels whereby the surface temperature of said outlet area is maintained below the temperature at which the solids in said solids-containing fluid medium agglomerate.

6. An apparatus for projecting a solids-containing fluid medium into an arc column comprising:

a. an anode and a cathode having a conical tip;

b. means for providing a free-burning arc discharge between said anode and said cathode whereby said arc discharge forms a plasma bubble and a contraction in the current-carrying area in the transition region in the vicinity of the cathode;

c. directing means for projecting a solids-containing fluid medium substantially parallel to the surface of the conical tip of said cathode into said contraction of the current-carrying area along a path which intersects beyond said plasma bubble, comprising a plurality of individual linear feed channels having a constant flow cross-sectional area, said individual feed channels being supplied by individual solids-containing fluid medium of essentially equal flow rate and grain loading.

7. In the process of energizing a reactive material comprising a solids-containing fluid medium by means of a free-burning arc discharge between an anode and a cathode having a conical tip, wherein said arc discharge forms a contraction of the current-carrying area in the transition region in the vicinity of the cathode and wherein said reactive material is forcefully projected parallel to the surface of said conical tip of said cathode into and through said contraction of the current-carrying area in the transition region in the vicinity of the cathode, the improvement comprising projecting said reactive material through a plurality of individual linear feed channels having a constant flow cross-sectional area, said individual feed channels being supplied by individual solids-containing fluid medium of essentially equal flow rate and grain loading.

* * * * *